US007132387B2

(12) United States Patent
Yamagishi et al.

(10) Patent No.: US 7,132,387 B2
(45) Date of Patent: Nov. 7, 2006

(54) HEAT SENSITIVE RECORDING MATERIAL

(75) Inventors: Naoya Yamagishi, Ogaki (JP); Hitomi Hioki, Nagoya (JP); Kiyoichi Ohta, Chiryu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 152 days.

(21) Appl. No.: 10/944,001

(22) Filed: Sep. 20, 2004

(65) Prior Publication Data

US 2005/0070432 A1 Mar. 31, 2005

(30) Foreign Application Priority Data

Sep. 25, 2003 (JP) ..... 2003-333514

(51) Int. Cl.
*B41M 5/40* (2006.01)

(52) U.S. Cl. ..... 503/226; 503/200

(58) Field of Classification Search ..... 503/200, 503/226

See application file for complete search history.

(56) References Cited

U.S. PATENT DOCUMENTS 5,981,429 A 11/1999 Kawamura et al.

FOREIGN PATENT DOCUMENTS

| | | |
|---|---|---|
| JP | B2 58-35478 | 8/1983 |
| JP | A 64-4387 | 1/1989 |
| JP | A 01-280584 | 11/1989 |

*Primary Examiner*—Bruce H. Hess
(74) *Attorney, Agent, or Firm*—Oliff & Berridge, PLC

(57) ABSTRACT

A heat sensitive recording material comprises a heat sensitive color forming layer formed on a support and containing a color forming compound and a color developing compound in reaction with the color forming compound to develop a color; an intermediate layer formed on the heat sensitive color forming layer; and a protective layer formed on the intermediate layer and comprising a UV-ray curable resin. The intermediate layer is formed of a composition containing an acrylic emulsion and a polyvinyl alcohol.

6 Claims, No Drawings

HEAT SENSITIVE RECORDING MATERIAL

BACKGROUND OF THE INVENTION

1. Field of the Invention

The present invention relates to a heat sensitive recording material obtained by forming an intermediate layer on a heat sensitive color forming layer of a support and forming a protective layer comprising a UV-ray curable resin on the intermediate layer and, more in particular, it relates to a heat sensitive recording material of excellent light fastness capable of improving the close adhesion with the protective layer while protecting the heat sensitive color forming layer against the UV-ray curable resin constituting the protective layer and capable of preventing discoloration at the background of the support based on an oxygen-shielding property, by forming the intermediate layer with a composition containing an acrylic emulsion and a polyvinyl alcohol.

2. Description of Related Art

Heretofore, heat sensitive recording materials of utilizing colorless or pale colored color forming materials and color developing materials capable of causing the coloring forming materials to form colors upon heating have been generally known publicly and such heat sensitive recording materials can be obtained by dispersing a leuco dye and a color developing agent such as a phenolic material separately each in a finely particulate state, then mixing both of them, adding additives such as a binder, a sensitizer, a filler and a lubricant thereto to prepare a coating solution and then coating the same on a support such as paper, film or synthesis paper. While thermal printers incorporating a thermal head are used for coloring such a heat sensitive recording sheet, they are used generally in the field, for example, of facsimiles, automatic ticket machines and heat sensitive recording type labels by taking the advantageous features of causing less noises, being maintenance free, and the machines are relatively inexpensive compared with other recording methods.

Further, for providing the heat sensitive recording sheet with solvent resistance, plasticizer resistance, and water proofness, provision of a protective layer on a heat sensitive color forming layer is described, for example, in Japanese patent unexamined application publication No. 64(1989)-4387 and use of a UV-ray curable resin for forming the protective layer is described in Japanese patent examined application publication No. 58(1983)-35478.

However, the protective layer formed of the UV-curable resin has a drawback that adhesion with heat sensitive color forming layer is poor and easily defoliated by fraction or an adhesive tape. Further, for improving the light fastness, it is necessary to increase the thickness of the protective layer, which results in a problem of increase in the cost of the material for forming the protective layer or a problem of causing cracking in the protective layer.

For improving the adhesion between the heat sensitive color forming layer and the protective layer, it may be considered to provide an intermediate layer between the heat sensitive color forming layer and the protective layer. However, in a case of forming the protective layer from the UV-ray curable resin, an intermediate layer capable of simultaneously improving the adhesion with the protective layer while protecting the heat sensitive color forming layer against the UV-ray curable resin, and preventing discoloration at the background of a support to which the heat sensitive color forming layer is formed by providing the intermediate layer with oxygen shielding property has not yet been present so far.

SUMMARY OF THE INVENTION

The present invention has been made in view of the above circumstances and has an object to overcome the above problems and to provide a heat sensitive recording material of excellent light fastness capable of improving the adhesion with the protective layer while protecting the heat sensitive color forming layer against the UV-ray curable resin constituting the protective layer and capable of preventing discoloration at the background of the support based on an oxygen-shielding property, by forming an intermediate layer with an composition containing an acrylic emulsion and a polyvinyl alcohol between a heat sensitive color forming layer and a protective layer formed of a UV-ray curable resin.

To achieve the purpose of the invention, there is provided a heat sensitive recording material comprising: a heat sensitive color forming layer formed on a support and containing a color forming compound and a color developing compound in reaction with the color forming compound to develop a color; an intermediate layer formed on the heat sensitive color forming layer; and a protective layer formed on the intermediate layer and comprising a UV-ray curable resin, wherein the intermediate layer is formed of a composition containing an acrylic emulsion and a polyvinyl alcohol.

In the above heat sensitive recording material, preferably, the acrylic emulsion and the polyvinyl alcohol are contained within a range of 80:20 to 20:80 by solid content ratio in the composition. Preferably, the solid content ratio between the acrylic emulsion and the polyvinyl alcohol is within a range of 70:30 to 30:70.

Further, preferably, the acrylic emulsion comprises, as a main ingredient, an acrylic acid ester copolymer having a glass transition temperature within a range of 20° C. to 150° C., and the polyvinyl alcohol has an average polymerization degree within a range of 300 to 3000 and a saponification degree within a range of 40% to 100%.

In the heat sensitive recording material according to the invention, since the intermediate layer comprising the composition containing the acrylic emulsion and the polyvinyl alcohol is formed between the heat sensitive color forming layer and the protecting layer formed of the UV-ray curable resin, the acrylic emulsion ingredient in the composition can protect the heat sensitive color forming layer by preventing the heat sensitive color forming layer from coloration upon forming the protective layer from the UV-ray curable resin dissolved in an organic solvent and can outstandingly improve the adhesion between the heat sensitive color forming layer and the protective layer. Further, discoloration at the background of the support can be prevented due to the oxygen shielding property of the polyvinyl alcohol ingredient in the composition.

Further, in a case where the intermediate layer is formed of a composition containing the acrylic emulsion and the polyvinyl alcohol within a range of 80:20 to 20:80 by solid content ratio and adjusted so as to contain the acrylic emulsion and the polyvinyl alcohol within the range described above, the anti-coloration property of the heat sensitive color forming layer and the improvement for the adhesion between the heat sensitive color forming layer and the protective layer due to the acrylic emulsion ingredient can be provided suitably. Further, the oxygen shielding property due to the polyvinyl alcohol can be provided suitably.

Further, in a case where the intermediate layer is formed of a composition containing the acrylic emulsion and the polyvinyl alcohol within a range of 70:30 to 30:70 by solid content ratio and adjusted so as to contain the acrylic emulsion and the polyvinyl alcohol within the range described above, the anti-coloration property of the heat sensitive color forming layer and the improvement for the adhesion between the heat sensitive color forming layer and the protective layer due to the acrylic emulsion ingredient can be provided further suitably. Further, the oxygen shielding property due to the polyvinyl alcohol can be provided more suitably.

DETAILED DESCRIPTION OF THE PREFERRED EMBODIMENTS

The heat sensitive recording material according to the present invention is to be described with reference to embodiments of the invention.

For the ingredients of the heat sensitive color forming layer formed on the support in the heat sensitive recording material according to the embodiment, a color forming compound, a color developing compound, a binder and, optionally, a filler, a heat melting compound, a surfactant, etc. are used. Specific examples for each of the ingredients are to be exemplified below.

The color forming compound can include, for example, fluoran series compounds, triaryl methane series compounds, spiropyran series compounds, diphenyl methane series compounds, thiazine series compounds, lactam series compound, and fluorene series compounds, and specific examples of them can include, for example, the following compounds.

The fluoran series compound can include, for example, 2-anilino-3-methyl-6-diethylaminofluoran, 2-anilino-3-methyl-6-(N-methyl-N-cyclohexylamino)-fluoran, 2-anilino-3-methyl-6-(N-ethyl-N-isopentylamino)fluoran, 2-anilino-3-methyl-6-dibutylaminofluoran, 2-(p-chloroanilino)-3-methyl-6-diethylaminofluoran, 2-(p-fluoroanilino)-3-methyl-6-diethylaminofluoran, 2-anilino-3-methyl-6-(p-toluidinoethylamino)fluoran, 2-(p-toluidino)-3-methyl-6-diethylaminofluoran, 2-(o-chloroanilino)-6-dibutylaminofluoran, 2-(o-fluoroanilino-6-diethylaminofluoran, 2-(o-fluoroanilino)-6-dibutylaminofluoran, 2-anilino-3-methyl-6-piperidinofluoran, 2-anilino-3-methyl-6-pirolidinofluoran, 2-ethoxyethylamino-3-chloro-6-diethylaminofluoran, 2-anilino-3-chloro-6-diethylfluoran, 2-chloro-6-diethylaminofluoran, 2-methyl-6-diethylaminofluoran, 2-anilino-3-methyl-6-(N-ethyl-N-ethoxypropylamino)fluoran, and 2-anilino-3-methyl-6-dipentylaminofluoran. Triarylmethane series compounds can include, for example, 3,3-bis(p-dimethylaminophenyl)-6-dimethylaminophthalide (other name of crystal violet lactone), 3,3-bis(p-dimethylaminophenyl) phthalide and 3-(p-dimethylaminophenyl)-3-(1,2-dimethylaminoindol-3-)in phthalide. Spiropyran series compound can include, for example, 3-methyl-3-spiro-dinaphthopiran and 1,3,3-trimethyl-6-nitro-8'-methoxyspiro(indoline 2,2'-benzopiran). Diphenylmethane series compounds can include, for example, N-halophenyl-leucoauramine; thiazine series compounds can include, for example, benzoylluecomethylene blue. Lactam series compounds can include, for example, rhodamine-B-anilinolactam. Fluorene series compounds can include, for example, 3,6-bis(dimethylamino) fluorene spiro (9,3')-6-dimethylaminophthalide, and [3,6-bis (dimethylamino) fluorene spiro (9,3')-6'-pyrrolidino phthalide], and [3-dimethylamino-6-diethylaminofluorene spiro (9,3')-6'-pyrrolidinophthalido]. The coloring forming compounds described above are used solely or as a mixture.

The color developing compounds can include phenolic compounds such as α-naphthol, β-naphthol, p-octylphenol, 4-t-octylphenol, p-t-butylphenol, p-phenylphenol, 1,1'-bis (p-hydroxyphenyl)propane, 2,2'-bis(p-hydroxyphenyl)propane, 2,2'-bis(p-hydroxyphenyl)butane, 1,1'-bis(p-hydroxyphenyl)cyclohexane, 4,4'-thiobisphenol, 4,4'-cyclohexylidenediphenol, 4,4'-sulfonyldiphenol, 4,4'-sulfonyl-bis (2-allylphenol), 4-hydroxy-4'-isopropoxy-diphenylsulfone, 1,1,3-tris(3-t-butyl-4-hydroxy-6-methylphenyl)butane, 2,2'-bis(2,5-dibrom-4-hydroxyphenyl)propane, 4,4'-isopropyridene bis(2-t-butylphenyl), 2,2'-methylene bis(4-chlorophenol), 1,1,3-tris(3-t-butyl-4-hydroxy-6-cyclohexylphenyl) butane, methylbis(4-hydroxyphenyl)acetate, butylbis(4-hydroxyphenyl)acetate, and benzylbis(4-hydroxyphenyl) acetate; and aromatic carboxylic acid derivatives and aromatic carboxylic acids such as benzyl p-hydroxy benzoate, ethyl p-hydroxy benzoate, dibenzyl 4-hydroxy phthalate, dimethyl 4-hydroxy phthalate, 5-hydroxy ethyl isophthalate, 3,5-di-t-butyl salicylic acid, 3,5-di-α-methylbenzylsalicylic acid; or polyvalent metal salts thereof.

The binder can include, for example, water soluble materials such as methyl cellulose, methoxycellulose, hydroxyethylcellulose, carboxymethyl, sodium carboxymethyl cellulose, cellulose, polyvinyl alcohol (PVA), carboxy group-modified polyvinyl alcohol, sulfonic acid group-modified polyvinyl alcohol, polyvinyl pyrrolidone, polyacrylamide, polyacrylic acid, starch and derivatives thereof, casein, gelatin, water soluble isoprene rubber, alkali salts of styrene/maleic acid anhydride copolymer, alkali salts of iso(or diiso)butyrene/maleic acid anhydride copolymer, or polyvinyl acetate, vinyl chloride/vinyl acetate copolymer, polystyrene, polyacrylate, polyurethane, styrene/butadiene (SB) copolymer, carboxylated styrene/butadiene(SB) copolymer, styrene/butadiene/acrylic acid copolymer, composite particles of colloidal silica and acrylic resin, and aqueous emulsions thereof.

Examples of other additives can include, for example, calcium carbonate, magnesium carbonate, magnesium oxide, silica, white carbon, talc, clay, alumina, magnesium hydroxide, aluminum hydroxide, aluminum oxide, barium sulfate, polystyrene resin, and urea-formalin resin.

The heat melting compound can include, for example, waxes such as animal and vegetable waxes, polyethylene wax and synthesis wax, higher fatty acid, higher aliphatic amide, higher fatty acid metal salts, acetylation products of aromatic amine, aromatic ether compounds, and biphenyl derivatives.

In addition, lubricants such as zinc stearate, calcium stearate and aluminum stearate, various kinds of surfactants, and defoamers are added optionally.

Further, as the support for the heat sensitive recording material, paper, plastic film, synthesis paper and the like are used. Among all, a plastic film of high oxygen shielding property is a particularly preferred support for obtaining the effect of light fastness since the use thereof can prevent oxidation of the heat sensitive color forming layer also from the lower layer thereof.

The plastic film can include, for example, film of polyester, polypropylene, polyethylene, polystyrene or nylon.

The heat sensitive color forming layer can be formed on the support, for example, by the following methods.

At first, a color forming compound and a color developing compound are pulverized and dispersed separately together with a binder or optionally other additives by a dispersing machine such as ball mill, attritor, or sand mill, then, mixed to each other to prepare a coating solution of a heat sensitive color forming layer, coated on a support such as of paper, plastic sheet, synthesis paper or the like usually at a dry weight from 1 to 20 g/m$^2$ by using a bar coater, blade coater or the like (ratio of the color forming compound and the color developing compound usually at 2:1 to 1:10 by dry weight ratio) followed by drying.

Then, for preparing an intermediate layer to be formed on the heat sensitive color forming layer, a composition containing an acrylic emulsion and a polyvinyl alcohol is used.

The acrylic emulsion mainly comprises, as a main ingredient, an acrylic acid ester copolymer with a glass transition temperature within a range of 20° C. to 150° C., and the polyvinyl alcohol has a property with an average degree of polymerization within a range of 300 to 3000 and a saponification degree within a range of 40% to 100%. In the composition forming the intermediate layer, the acrylic emulsion and the polyvinyl alcohol are contained preferably within a range of 80:20 to 20:80 by solid content ratio and, more preferably, the solid content ratio between the acrylic emulsion and the polyvinyl alcohol is within a range of 70:30 to 30:70.

In a case where the solid content ratio between the acrylic emulsion and the polyvinyl alcohol is within a range of 80:20 to 20:80 and, preferably, within a range of 70:30 to 30:70, properties due to both of the ingredients can be provided sufficiently. Specifically, the acrylic emulsion ingredient can protect the heat sensitive color forming layer by preventing the heat sensitive color forming layer from coloration upon forming the protective layer from the UV-ray curable resin dissolved in the organic solvent, and can outstandingly improve the adhesion between the heat sensitive color forming layer and the protective layer. In addition, discoloration at the background of the support can be prevented by the oxygen shielding property of the polyvinyl alcohol ingredient.

In a case where the solid content ratio of the acrylic emulsion exceeds 80, the anti-coloring property for the heat sensitive color forming layer and the adhesion improving property between the heat sensitive color forming layer and the protective layer as the characteristics thereof become excessively strong, whereas the oxygen shielding property due to the polyvinyl alcohol is weakened. On the other hand, in a case where the solid content ratio of the acrylic emulsion is 20 or less, the anti-coloring property of the heat sensitive color forming layer and the adhesion improving property between the heat sensitive color forming layer and the protective layer are weakened, whereas the oxygen shielding property due to the polyvinyl alcohol becomes excessively strong.

In the same manner, in a case where the solid content ratio of the polyvinyl alcohol exceeds 80, the oxygen shielding property as the characteristic thereof becomes excessively strong, whereas the anti-coloring property for the heat sensitive color forming layer and the adhesion improving property between the heat sensitive color forming layer and the protective layer due to the acrylic emulsion are weakened. Further, in a case where the solid content of the polyvinyl alcohol is 20 or less, the oxygen shielding property is weakened, whereas the anti-coloring property for the heat sensitive color forming layer and the adhesion improving property between the heat sensitive color forming layer and the protective layer due to the acrylic emulsion becomes excessively strong.

As described above, the extent at which the characteristics of the acrylic emulsion and the polyvinyl alcohol are developed depends on the solid content ratio between them and the characteristics of both of them can be provided sufficiently when the solid content ratio is within a range of 80:20 to 20:80, preferably, 70:30 to 30:70. A most preferred solid content ratio between the acrylic emulsion and the polyvinyl alcohol is 50:50. In such a case, each of the properties described above due to the acrylic emulsion and the polyvinyl alcohol respectively can be developed in a well-balanced state.

In the composition constituting the intermediate layer, the additives described above may be added optionally.

For example, usual fillers such as clay, talc, kaolinite, titanium oxide, zinc oxide, calcium carbonate, and aluminum oxide, finely particulate resins such as urea-formalin resin, polystyrene, benzoguanamin resin and phenol resin, surfactants such as fatty acid salts, aromatics, sulfonic acid salts, polycarboxylic acid salts, and dialkyl sulfo succinic acid salts, and hydration resistant agents such as glyoxal, methylolmelamine or water soluble epoxy compounds may also be used together optionally to the intermediate layer.

The composition forming the intermediate layer described above is thoroughly mixed by a general mixing stirrer, such as a mixer, attritor or sand mill and then coated and dried on a heat sensitive recording layer by a coating apparatus such as a bar coater, roll coater, gravure coater or air knife coater. The amount of the intermediate layer to be coated is, preferably, from 0.1 to 10 g/m$^2$ and, particularly, from 0.5 to 5 g/m$^2$ by dry weight.

A UV-ray curable protective layer is disposed on the thus formed intermediate layer. The UV-ray curable resin used for the protective layer contains a resin ingredient such as a photopolymerizable monomer, prepolymer or polymer and a photopolymerization initiator each as main ingredients.

Examples of the prepolymer can include, for example, those prepolymers such as poly(meth)acrylates, poly(meth) acryloyloxy alkyl phosphate, polyester poly(meth)acrylates, epoxy(meth)acrylates, polyurethane poly(meth)acrylates, polyamide(meth)polyacrylates and polysiloxane poly(meth) acrylates of aliphatic, cycloaliphatic or araliphatic 2 to 6 polyhydric alcohols and polyalkylene glycols, and vinylic or dienic low polymers having meth(acryloyloxy group) on the side chains and/or terminals. Examples of the monomer can include, for example, alkyl esters of ethylenically unsaturated carboxylic acids, mono(meth)acrylates of alkylene oxide addition polymer of compounds containing active hydrogen, amide group-containing monomers typically represented by vinyl lactams such as 2-functional monomeric N-vinyl pyrrolidon comprising diesters of alkylene oxide addition polymers of compounds having active hydrogen and (meth)acrylic acid, and polyfunctional monomers comprising polyesters of alkylene oxide addition polymers of compounds having active hydrogen and (meth)acrylic acid. Examples of the photopolymerization initiator can include, for example, benzophenone, 2-hydroxy-2-methyl-propiophenone, 1-hydroxy-cyclohexyl phenylketone, and 2,4-diethylthioxantone.

Further, a photopolymerization accelerator, organic or inorganic filler, lubricant, surfactant, etc. can be added optionally. The coating amount is preferably from 1 to 6 g/m$^2$ by the weight on solid content.

The composition for forming the protective layer is a composition prepared from the UV-curable resin as the main ingredient and a colored pigment or extender pigment and, optionally, wax or stabilizer. Radiation-curable resin composition obtained as described above is coated on the intermediate layer using, for example, an existent roll coater, bar coater, gravure coater, flexo coater, or screen printing machine, and, in a case of dilution with a solvent or the like, irradiated with UV-rays after coating and drying to cure the coating film. The amount of the overcoat layer to be coated is usually within a range preferably from 0.5 to 10 g/m$^2$ and, more preferably, from 1 to 5 g/m$^2$ as dry weight.

Examples of heat sensitive recording material constituted as described above is to be explained.

EXAMPLES

The heat sensitive recording material is described more specifically with reference to examples, but the invention is no way limited to such examples. Further, unless otherwise specified, "part" and "%" in the examples represent "part by weight" and "% by weight", respectively.

Example 1

| [Preparation of solution A] | |
|---|---|
| 3-dibutylamino-7-(o-chloroanilino)fluoran: | 25 parts |
| Aqueous 25% PVA solution: | 20 parts |
| Water: | 55 parts |

The composition was pulverized to an average grain size of 2 μm or less by using a sand grinder.

| [Preparation of solution B] | |
|---|---|
| 2,2-bis(p-hydroxyphenyl) propane: | 25 parts |
| Aqueous 25% PVA solution: | 20 parts |
| Water: | 55 parts |

The composition was pulverized to an average grain size of 2 μm or less by using a sand grinder.

[Formation of Heat Sensitive Color Forming Layer]

Solution A/solution B were mixed and stirred at a ratio of 1:3 to prepare a coating solution. The obtained coating solution was coated and dried on a white foamed polyester film (CRYSPAR G2311, manufactured by Toyobo Co., Ltd.) by using a wire bar such that the dry weight was 8 g/m$^2$, to form a heat sensitive color forming layer.

| [Formation of intermediate layer] | |
|---|---|
| 40% acrylic emulsion:<br>(JULIMER FC-30, glass transition temperature: 25° C., manufactured by Nihon Junyaku Co., Ltd.) | 20 parts |
| 10% polyvinyl alcohol:<br>(NH-05, manufactured by Nippon Synthetic Chemical Industry Co., Ltd., polymerization degree: 400, saponification degree: 72%) | 80 parts |

Using the liquid mixture described above as a coating solution which was coated and dried on the previously prepared heat sensitive color forming layer by using a wire bar such that the dry weight was 2 g/m$^2$, to form an intermediate layer.

[Formation of Protective Layer]

Then, after coating a UV-ray curable ink (UNIDEX 17-824-9, manufactured by Dainippon Ink and Chemicals, Inc.) by 2 g/m$^2$ on the intermediate layer, it was cured by a UV-ray irradiation apparatus: UNICURE manufactured by Ushio Denki Inc. (at a position 200 mm below 80 W high pressure mercury lamp, at a line speed of 2000 mm/min) to obtain a heat sensitive recording material of the invention.

Example 2

A heat sensitive recording material was obtained in the same manner as in Example 1 except for using an intermediate layer coating solution obtained by mixing the following compounds for the intermediate layer in Example 1.

| [Formation of intermediate layer] | |
|---|---|
| 40% acrylic emulsion:<br>(JULIMER FC-30, glass transition temperature: 25° C., manufactured by Nihon Junyaku Co., Ltd.) | 36 parts |
| 10% polyvinyl alcohol:<br>(NH-05, manufactured by Nippon Synthetic Chemical Industry Co., Ltd., polymerization degree: 400, saponification degree: 72%) | 62 parts |

Example 3

A heat sensitive recording material was obtained in the same manner as in Example 1 except for using an intermediate layer coating solution obtained by mixing the following compounds for the intermediate layer in Example 1.

| [Formation of intermediate layer] | |
|---|---|
| 40% acrylic emulsion:<br>(JULIMER FC-30, glass transition temperature: 25° C., manufactured by Nihon Junyaku Co., Ltd.) | 9 parts |
| 10% polyvinyl alcohol:<br>(NH-05, manufactured by Nippon Synthetic Chemical Industry Co., Ltd., polymerization degree: 400, saponification degree: 72%) | 84 parts |

Example 4

A heat sensitive recording material was obtained in the same manner as in Example 1 except for using an intermediate layer coating solution obtained by mixing the following compounds for the intermediate layer in Example 1.

| [Formation of intermediate layer] | |
|---|---|
| 40% acrylic emulsion:<br>(JULIMER FC-30, glass transition temperature: 25° C., manufactured by Nihon Junyaku Co., Ltd.) | 50 parts |
| 10% polyvinyl alcohol:<br>(NH-05, manufactured by Nippon Synthetic Chemical Industry Co., Ltd., polymerization degree: 400, saponification degree: 72%) | 50 parts |

Example 5

A heat sensitive recording material was obtained in the same manner as in Example 1 except for using an intermediate layer coating solution obtained by mixing the following compounds for the intermediate layer in Example 1.

| [Formation of intermediate layer] | |
|---|---|
| 40% acrylic emulsion: (JULIMER FC-30, glass transition temperature: 25° C., manufactured by Nihon Junyaku Co., Ltd.) | 6 parts |
| 10% polyvinyl alcohol: (NH-05, manufactured by Nippon Synthetic Chemical Industry Co., Ltd., polymerization degree: 400, saponification degree: 72%) | 96 parts |

Comparative Example 1

A heat sensitive recording material was obtained in the same manner as in Example 1 except for using an intermediate layer coating solution obtained by mixing the following compounds for the intermediate layer in Example 1.

| [Formation of intermediate layer] | |
|---|---|
| 40% acrylic emulsion (JULIMER FC-30, glass transition temperature: 25° C., manufactured by Nihon Junyaku Co., Ltd.) | 100 parts |
| 10% polyvinyl alcohol (NH-05, manufactured by Nippon Synthetic Chemical Industry Co., Ltd., polymerization degree: 400, saponification degree: 72%) | 0 part |

Comparative Example 2

A heat sensitive recording material was obtained in the same manner as in Example 1 except for using an intermediate layer coating solution obtained by mixing the following compounds for the intermediate layer in Example 1.

| [Formation of intermediate layer] | |
|---|---|
| 40% acrylic emulsion (JULIMER FC-30, glass transition temperature: 25° C., manufactured by Nihon Junyaku Co., Ltd.) | 0 part |
| 10% polyvinyl alcohol (NH-05, manufactured by Nippon Synthetic Chemical Industry Co., Ltd., polymerization degree: 400, saponification degree: 72%) | 100 parts |

Table 1 shows the result of evaluation by using each of the heat sensitive recording materials obtained as described above. Printing was conducted by a label printer "PT-65" manufactured by Brother Industries Ltd. and light fastness was evaluated by an acceleration test under irradiation for 200 hours by a fade meter "TABLE SUN" manufactured by Suga Test Instruments Co., Ltd. (corresponding to 1 year in room). As the evaluation standards, those described below are adopted.

TABLE 1

| | CE1 | EX4 | EX2 | EX1 | EX3 | EX5 | CE2 |
|---|---|---|---|---|---|---|---|
| Solid content of Acrylic emulsion | 100% | 80% | 70% | 50% | 30% | 20% | 0% |
| Solid content of Polyvinyl alcohol | 0% | 20% | 30% | 50% | 70% | 80% | 100% |

TABLE 1-continued

| | | CE1 | EX4 | EX2 | EX1 | EX3 | EX5 | CE2 |
|---|---|---|---|---|---|---|---|---|
| 1) | 0 | 0.09 | 0.09 | 0.09 | 0.09 | 0.09 | 0.09 | 0.09 |
| Discoloration | 25 | 0.18 | 0.16 | 0.15 | 0.14 | 0.13 | 0.12 | 0.09 |
| at background | 50 | 0.15 | 0.15 | 0.15 | 0.13 | 0.12 | 0.11 | 0.09 |
| of support | 75 | 0.18 | 0.17 | 0.17 | 0.16 | 0.14 | 0.12 | 0.10 |
| Irradiation | 100 | 0.23 | 0.21 | 0.21 | 0.20 | 0.16 | 0.14 | 0.10 |
| Time | 125 | 0.24 | 0.22 | 0.20 | 0.17 | 0.16 | 0.14 | 0.10 |
| | 150 | 0.26 | 0.24 | 0.22 | 0.20 | 0.18 | 0.16 | 0.12 |
| | 175 | 0.27 | 0.25 | 0.24 | 0.21 | 0.17 | 0.15 | 0.13 |
| | 200 | 0.27 | 0.25 | 0.24 | 0.20 | 0.18 | 0.14 | 0.12 |
| Decision | | X | Δ | Δ | ○ | ○ | ○ | ○ |
| 2) Close adhesion | | ○ | ○ | ○ | ○ | Δ | Δ | X |

EX: Example,
CE: Comparative Example

1) Discoloration at background: value measured for the not-color-formed recording surface by Macbeth reflection densitometer RD-914.

○ . . . Discoloration not conspicuous

Δ . . . Slight discoloration

×. . . Violent discoloration

2) Close adhesion: A pressure sensitive adhesive tape was pressed against and then peeled from the recording surface and the state of peeling for the protective layer or the printed layer was observed.

○ . . . No peeling

Δ . . . Slight peeling

×. . . Peeling

As apparent from Table 1, it can be seen that the heat sensitive recording material of Example 1 in which the solid content ratio between the acrylic emulsion and the polyvinyl alcohol is 50:50 shows no discoloration at the background of the support and no peeling. It can be seen that the heat sensitive recording material of Example 2 in which the solid content ratio is 70:30 shows slight discoloration at the background of the support but no peeling. It can be seen that the heat sensitive recording material of Example 3 in which the solid content ratio is 30:70 shows no discoloration at the background of the support and only slight peeling. It can be seen that the heat sensitive recording material of Example 4 in which the solid content ratio is 80:20 shows slight discoloration at the background of the support but no peeling. It can be seen that the heat sensitive recording material of Example 5 in which the solid content ratio between the acrylic emulsion and the polyvinyl alcohol is 20:80 shows no discoloration at the background of the support and only slight peeling.

It can be seen for the heat sensitive recording material in each of the Examples 1 to 5 that the acrylic emulsion and the polyvinyl alcohol can develop both of their characteristics sufficiently when the solid content ratio between them is within a range of 80:20 to 20:80.

On the contrary, it can be seen that the heat sensitive recording material of Comparative Example 1 in which the solid content ratio between the acrylic emulsion and the polyvinyl alcohol is at 100:0, shows no peeling but suffers from violent discoloration at the background of the support. Further, it can be seen that the heat sensitive recording material of Comparative Example 2 with the solid content ratio of 0:100 shows no discoloration at the background of the support but causes remarkable peeling.

As described above, the present invention can provide a heat sensitive recording material of excellent light fastness capable of improving the adhesion with the protective layer while protecting the heat sensitive color forming layer from the UV-ray curable resin constituting the protective layer and capable of preventing discoloration at the background of the support based on the oxygen-shielding property, by forming the intermediate layer of the composition containing the acrylic emulsion and the polyvinyl alcohol between the heat sensitive color forming layer and the protective layer formed of the UV-ray curable resin.

What is claimed is:

1. A heat sensitive recording material comprising:

a heat sensitive color forming layer formed on a support and containing a color forming compound and a color developing compound in reaction with the color forming compound to develop a color;

an intermediate layer formed on the heat sensitive color forming layer; and a protective layer formed on the intermediate layer and comprising a UV-ray curable resin, wherein the intermediate layer is formed of a composition containing an acrylic emulsion and a polyvinyl alcohol.

2. The heat sensitive recording material according to claim 1, wherein the acrylic emulsion and the polyvinyl alcohol are contained within a range of 80:20 to 20:80 by solid content ratio in the composition.

3. The heat sensitive recording material according to claim 2, wherein the solid content ratio between the acrylic emulsion and the polyvinyl alcohol is within a range of 70:30 to 30:70.

4. The heat sensitive recording material according to claim 1, wherein the acrylic emulsion comprises, as a main ingredient, an acrylic acid ester copolymer having a glass transition temperature within a range of 20 to 150° C., and the polyvinyl alcohol has an average polymerization degree within a range of 300 to 3000 and a saponification degree within a range of 40% to 100%.

5. The heat sensitive recording material according to claim 2, wherein the acrylic emulsion comprises, as a main ingredient, an acrylic acid ester copolymer having a glass transition temperature within a range of 20° C. to 150° C., and the polyvinyl alcohol has an average polymerization degree within a range of 300 to 3000 and a saponification degree within a range of 40% to 100%.

6. The heat sensitive recording material according to claim 3, wherein the acrylic emulsion comprises, as a main ingredient, an acrylic acid ester copolymer having a glass transition temperature within a range of 20° C. to 150° C., and the polyvinyl alcohol has an average polymerization degree within a range of 300 to 3000 and a saponification degree within a range of 40% to 100%.

* * * * *